US006899240B2

(12) United States Patent
Dang et al.

(10) Patent No.: US 6,899,240 B2
(45) Date of Patent: May 31, 2005

(54) SUBGRADE VAULT

(75) Inventors: Nguyen Thai Dang, Pomona, CA (US); Reilly Flynn, Ontario, CA (US)

(73) Assignee: Carson Industries LLC, Glendora, CA (US)

( * ) Notice: Subject to any disclaimer, the term of this patent is extended or adjusted under 35 U.S.C. 154(b) by 91 days.

(21) Appl. No.: 10/256,266

(22) Filed: Sep. 25, 2002

(65) Prior Publication Data

US 2004/0055231 A1 Mar. 25, 2004

(51) Int. Cl.[7] ..... B65D 25/24
(52) U.S. Cl. ..... 220/3.8; 52/128
(58) Field of Search ..... 52/19, 20, 128, 52/169.6; 404/25–26; 220/3.8, 3.2–3.3, 327, 567.1; 24/74; 49/400–402, 57, 463; 312/265.6

(56) References Cited

U.S. PATENT DOCUMENTS 3,952,908 A * 4/1976 Carson ..... 220/484
4,163,503 A * 8/1979 McKinnon ..... 220/484
4,333,580 A * 6/1982 Sweigart, Jr. ..... 220/4.13
4,863,059 A * 9/1989 Christensen ..... 220/640
4,915,334 A * 4/1990 White ..... 248/188.4
5,139,306 A * 8/1992 Ott et al. ..... 296/198
5,362,174 A * 11/1994 Yang ..... 404/25
5,404,676 A * 4/1995 Devlin ..... 404/25
6,035,581 A * 3/2000 McCoy ..... 52/20
6,371,687 B1 * 4/2002 Heintz et al. ..... 404/26
6,371,688 B1 * 4/2002 Yang et al. ..... 404/26

FOREIGN PATENT DOCUMENTS

GB 2079355 A * 1/1982 ..... E03F/5/06
JP 03069724 A * 3/1991 ..... E02D/29/14

* cited by examiner

*Primary Examiner*—Peter M. Cuomo
*Assistant Examiner*—Stephen D'Adamo
(74) *Attorney, Agent, or Firm*—Donald D. Mon

(57) ABSTRACT

A subgrade vault to provide an enclosed housing for utility connections. The housing is made of a moldable material with a reinforcing skirt at one end and a seat in the other. A lid is received in the seat to close its upper end. A clip is optionally provided for fastening the lid to the housing body that can be clipped on the body and engaged by a fastener carried by the lid.

9 Claims, 4 Drawing Sheets

SUBGRADE VAULT

FIELD OF THE INVENTION

A vault to provide an enclosed region beneath a surrounding surface. The vault comprises a body, a lid, and a retainer for holding the lid closed across an opening formed by the vault body.

BACKGROUND OF THE INVENTION

Subgrade vaults are widely used to provide internal enclosed regions where connections can be made and housed. Classical examples of such connections are joinder of electrical cables used in street lighting, in telephone and communication systems, and water valves such as for golf courses.

Such vaults are by necessity placed below grade with their upper surfaces at grade where loads from pedestrians and vehicles are to be anticipated. Generally they will be used by municipalities, utilities, and other capital installations where longevity of the vaults, and affordability are important.

While it is possible to make an almost ultimately strong and long-lived product by using very expensive materials in excessive amounts, the realities of the marketplace will not support such a product. Accordingly, the use of less expensive materials that can be affordably processed is a logical objective. Of course such materials often have lesser inherent physical properties to resist mechanical loads and ravages of time and weather. These must be compensated by effective design.

In addition to resistance to outside forces, easiness of use is necessary. This is because labor costs associated with the servicing of systems accommodated in the vault are generally quite high. A lid to give access to the enclosed region must not only be strong enough, but must be simple to remove and replace, while reliably holding the lid onto the body when access is not needed.

It is another object of this invention to provide for various levels of protection against unauthorized removal of the lid such as by friction grips or fasteners with non-symmetrical arrays of driving surfaces.

It is an object of this invention to provide an improved vault, affordably manufactured as a molded organic plastic product, and especially to provide a reliable, readily manufactured clip to join with a bolt, removably to hold the lid to the body.

BRIEF DESCRIPTIONS OF THE INVENTION

A vault according to this invention includes a body having a peripheral wall to bound an enclosed region. The body has an open lower end and an open upper end. The upper end is bounded by a rim, and preferably forms a seat beneath the rim. A lid fits across the upper end, preferably with an underside plug that fits in the seat.

According to another preferred but optional feature of the invention, the body is a molded structure in which the seat includes a re-entrant wall and an inwardly extending flange to provide additional support for the lid when in place.

According to yet another preferred but optional feature of the invention, a U-shaped clip fits onto a lip on the flange. The clip includes a chimney-like projection with an internal thread on one arm, and a hole through the other arm. When placed on the lip, a bolt retained to the lid can be threaded into the clip to hold the lid onto the body.

According to another preferred but optional feature of the invention, the body is a molded structure in which the seat includes a re-entrant flange and an inwardly extending lip to provide additional support for the lid when in place.

According to yet another preferred but optional feature of the invention, an outwardly and upwardly extending skirt surrounds the bottom end of the body to provide positive resistance to distortion of the body which could be caused by loads exerted by earth, rocks or concrete while being placed around the vault.

The above and other features of this invention will be fully understood from the following detailed description and the accompanying drawings, in which:

DETAILED DESCRIPTION OF THE INVENTION

Figure 8:
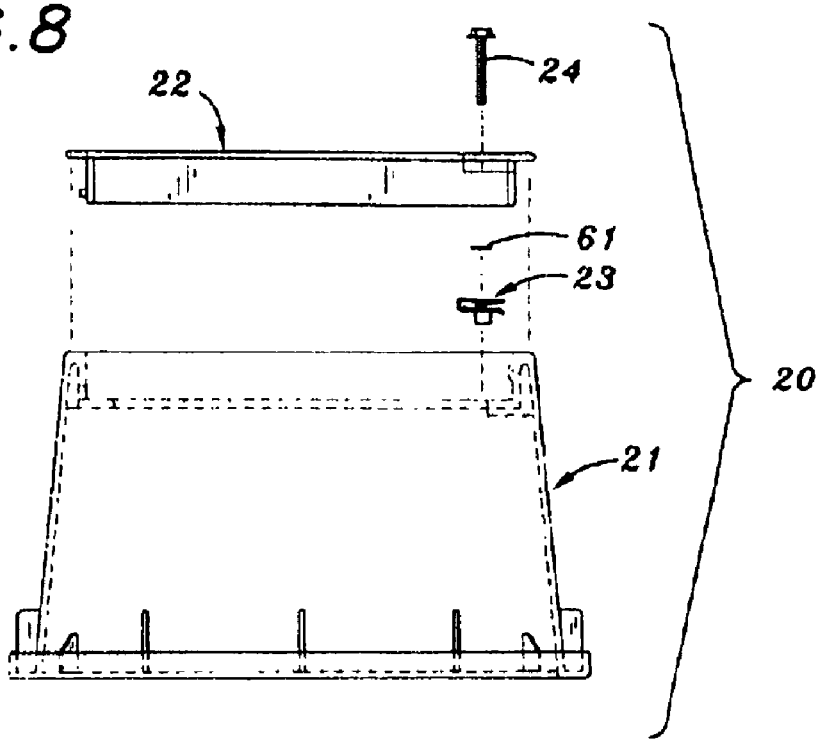
FIG. 8 is an exploded side view showing the assembly of a body, a lid, a fastener and a clip which together form the preferred embodiment of the vault.

As best shown in FIG. 8, a vault 20 according to this invention comprises a body 21, a lid 22, a clip 23 and a fastener 24. When the lid is brought down onto the body and the fastener is fastened to the clip, the joinder and assembly are exemplified in FIGS. 8 and 9

When the vault is assembled, it forms an enclosed region 25 within which connections (not shown) can be placed and accessed through the top end 30. Conventionally the conduits, cables, or valves being connected are brought into the region through the open bottom end 31 of the body. Customarily the body is buried in a surrounding region, such as soil, or abutted by gravel or concrete poured around it to stabilize it in place. The upper end of the body will be placed where, when the lid is attached, the upper surface of the lid will be at grade.

The peripheral wall 32 of the body is a quadrilateral frustum, sloping upwardly from the bottom end. If preferred, the bottom end could be the larger end, but structural considerations will prefer the illustrated shape over the reverse, or from a prismatic shape (which could also be used). Circular vaults are also in the scope of this invention, but quadrilaterals are generally preferred.

The illustrated shape is well-suited to manufacture by injection molding processes, which is an advantage in the reduction of cost. It is also amenable to rotational molding. The lower end includes an upwardly extending peripheral skirt 33. Attention is called to buttresses 34 which are integral with (or attached to) the inside of the skirt and the outside of the peripheral wall. These provide strong support for the skirt, which in turn provides significant rigidity to the lower end so that side forces are less likely to distort the shape of the body.

A rim 40 is formed at the top end of the body, where a seat 41 is formed by a re-entrant wall 42 that terminates in an inwardly-extending flange 43. A lip 44 is formed as an inward extension from flange 43, with a hole 45 therethrough for a purpose to be described.

Buttresses 46 fit between the outer surface of wall 42 and the inner surface of the peripheral wall. These buttresses may be molded as part of the body or later cemented or solvent welded in as preferred. However, it will be noted that all elements of the body as shown are suitable for molding in a single operation, perhaps drilling the hole as a second operation.

In the event that a positive lock for the lid is not necessary a rise 49, which may be one or more dimples, or a circumferential band, is formed on the inside of the re-entrant wall. It will frictionally engage to the lid to be described, and require extra force to remove the lid.

Figure 2:
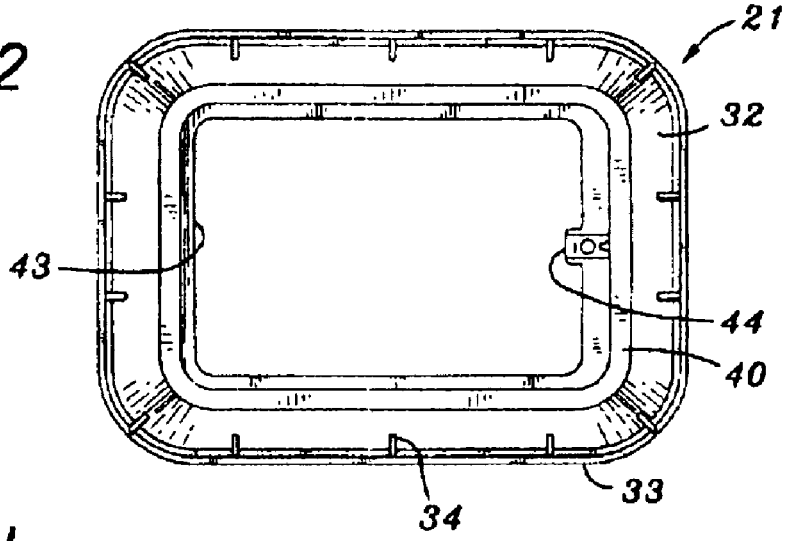
FIG. 2 is a top-view taken at line 2—2 in FIG. 1.
Figure 1:
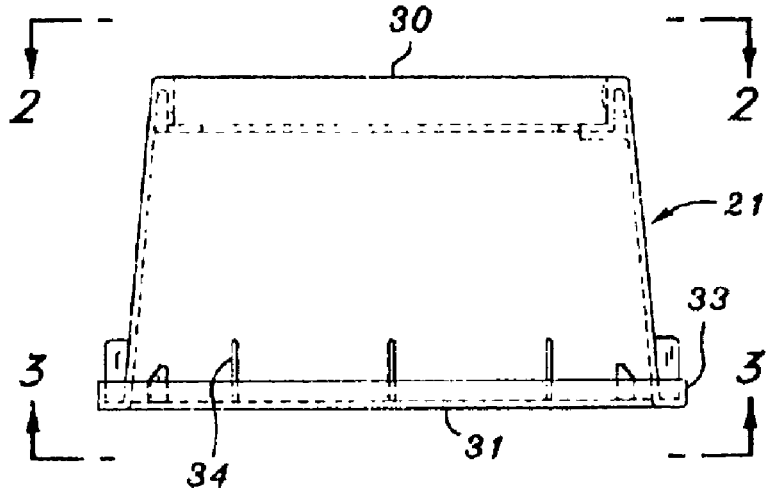
FIG. 1 is a side view of a body according to the invention.
Figure 3:
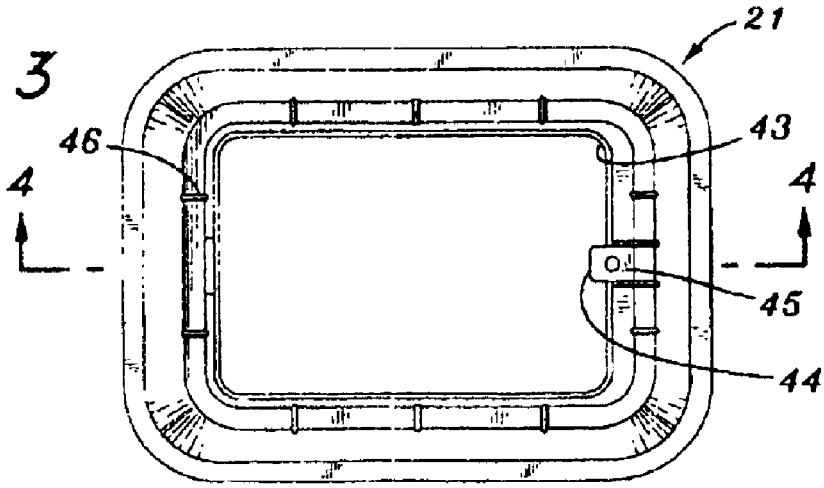
FIG. 3 is a bottom view taken at line 3—3 in FIG. 1.
Figure 4:
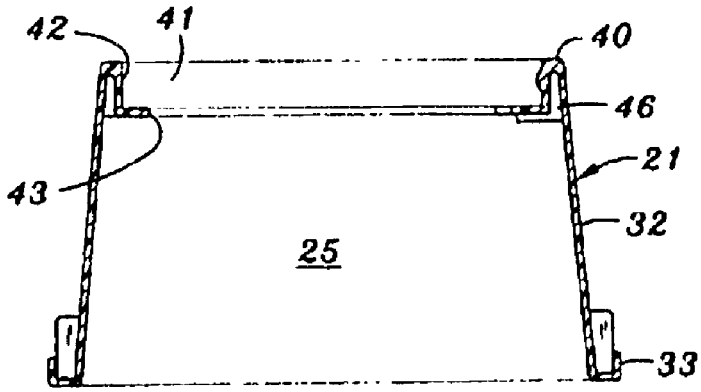
FIG. 4 is a cross-section taken at line 4—4 in FIG. 3.
Figure 6:
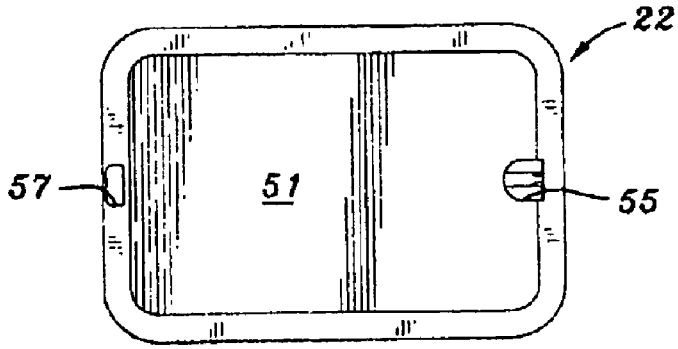
FIG. 6 is a top view taken at line 6—6 in FIG. 5.
Figure 5:
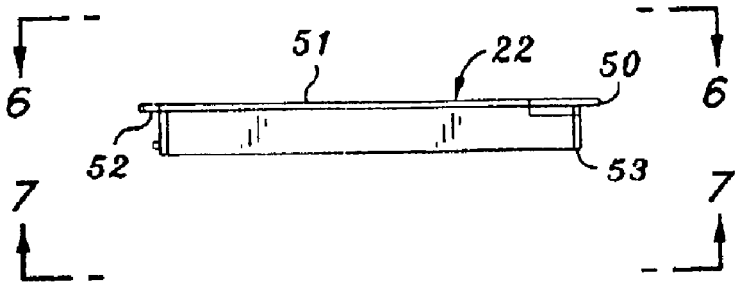
FIG. 5 is a side view of a lid according to the invention.
Figure 7:
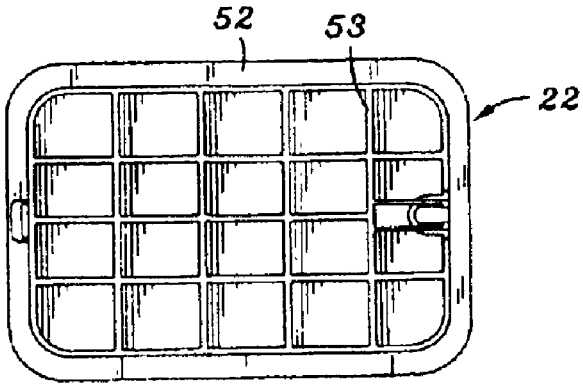
FIG. 7 is a bottom view taken at line 7—7 in FIG. 5.

Lid 22 is best shown in FIGS. 5–7. It includes a top plate 50 with an upper surface 51 and an optional shoulder 52 that extends around the edge of the lid.

The underside of the lid is formed as a plug 53 which is intended to fit in seat 41, bearing against re-entrant wall 42 and, depending on preference, with shoulder 52 bearing on the rim or the lower end of the plug bearing on flange 43, or both. To reduce its weight and cost, the bottom is relieved by a honeycombing with intersecting plates 53 forming voids between them. Rise 49 will engage the lid, and perhaps slightly indent into it.

Figure 9:
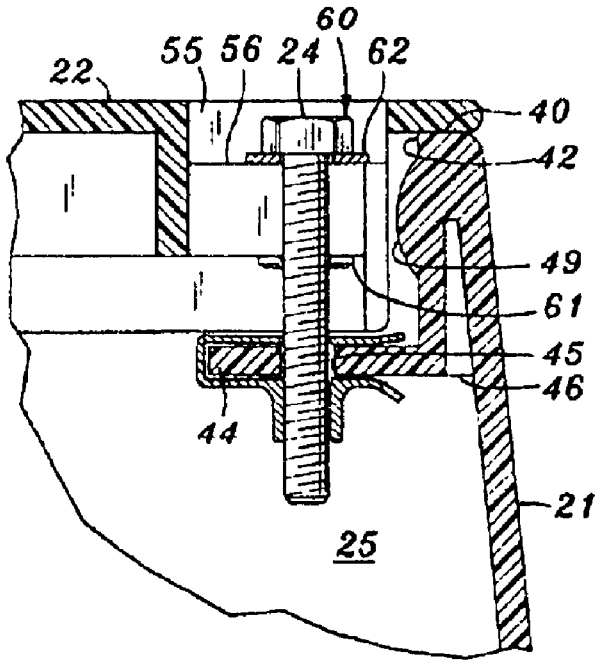
FIG. 9 is a fragmentary cross-section showing the fastener and clip holding the lid to the body.
Figure 11:
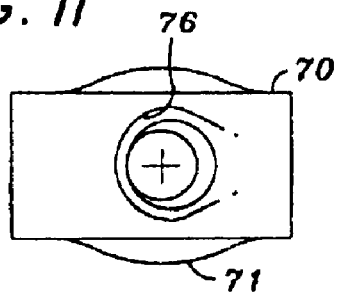
FIG. 11 is a top view of FIG. 10.
Figure 13:
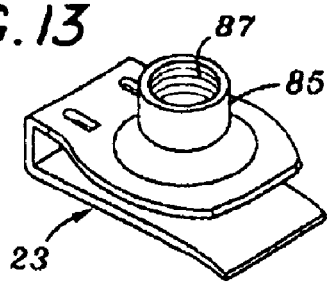
FIG. 13 is a perspective view of the fastener of FIG. 10.
Figure 10:
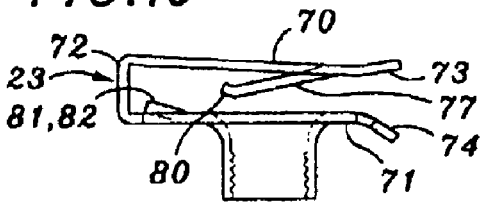
FIG. 10 is a side view of a clip according to the invention.
Figure 14:
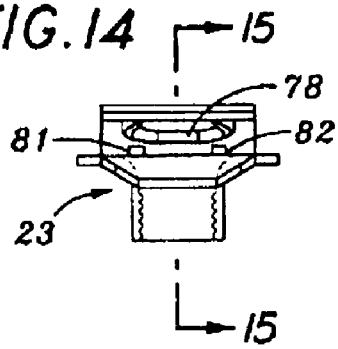
FIG. 14 is an end view of the clip of FIG. 12.
Figure 12:
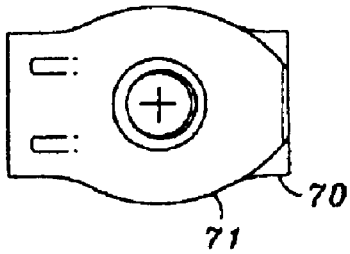
FIG. 12 is a bottom view of FIG. 10.
Figure 15:
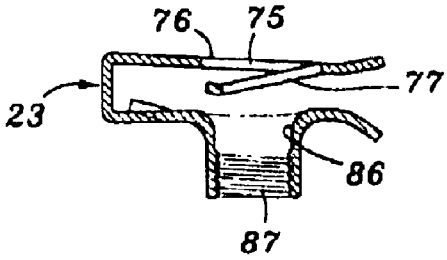
FIG. 15 is a cross-section taken at line 15—15 in FIG. 13.

As best shown in FIG. 9 a recessed opening 55 is formed through the lid near its edge. It has a shoulder 56 around the edge of the opening. A second opening 57 through the opposite edge of the lid is provided to facilitate removal of the lid from the body.

Lock means 60 comprise clip 23 and fastener 24. If desired, an E-ring 61 can be placed on the fastener at a spacing from the head. The E-ring can be removed with difficulty. While it is in place it will hold the fastener to the lid, but permit substantive axial movement of the fastener.

As best shown in FIG. 9, clip 23 is pressed over lip 44, where it overhangs hole 45. Fastener 24, which is a threaded, headed bolt, carries a washer 62 and passes through opening 55, bearing against the lid as shown. The E-ring can be used if ready separation of the bolt from the lid is not desired. The bolt is threaded into the clip, and the lid is locked in place. The lid can be removed after the bolt is unthreaded from the clip.

As a security measure, the head of the fastener may be coded in shape so as to require a special wrench to engage it. The conventional means for this is to provide an array of curving surfaces which is non-symmetrical. Basically this means avoiding parallel driving surfaces, or not providing any array at all, for example a circular head. A pentagonal array is a suitable example.

Clip 23 is uniquely advantageous to this vault, because it can readily be pushed onto the lip where it will retain itself even when not engaged by the fastener. Furthermore it can readily and inexpensively be manufactured from a strip of suitably strong metal, usually a stainless steel.

As shown in FIGS. 11–14, the clip has a pair of arms 70, 71 which are joined by a bight 72. The arms confront one another. Installation of the clip is facilitated by oppositely directed bends 73, 74 at the tips of the arms.

Upper arm 70 has an opening 75 therethrough with a partial circumference 76 from which a retainer 77 has been punched. The retainer has a complete hole 78 therethrough, and is formed as a catch, angled inwardly from its base area 70. In side view the retainer has a small bend 80 which enables the retainer to slide over the lip without digging into the plastic as a sharp end would. After installation, the retainer exerts a strong retentive force that may indent into the lip.

Lower arm 71 has a pair of catches 81, 82 punched in from the outside, further to retain the lip.

A neck 85 is formed on the lower arm, extending outwardly from the clip. It has a tubular wall 86 with an internal thread 87. The thread and the hole in the upper arm are aligned, and when the clip is installed these will be aligned with hole 45 in the lip, and with the fastener. The assembly with the lid is best shown in FIG. 9.

The neck may be made separately and fastened to the arm if desired. However, it is an advantage of the clip that it can be made from a single strip of metal by successive operations. The neck may readily be formed by impact extrusion, in which metal is deformed from the plane of the strip and extruded to form the neck. The free end of the neck will be squared off, and the inside threaded.

The retainer can be formed in a single or double blow, forming the hole in it, and then severing the metal around only part of the retainer while bending it to shape. The folds at the end of the bight are made by a simple folding operation.

The organic plastic material for the body and lid may be any suitable for the intended purpose. High density polyethylene or polypropylene family is one suitable example.

This invention provides a vault made up from a number of unique and readily manufactured parts. The parts themselves are economically made by routine procedures.

This invention is not limited by the embodiment shown in the drawings and described in the description, which is given by way of example and not of limitation, but only in accordance with the scope of the appended claims.

We claim:

1. A subgrade vault for providing an enclosed region to house utility connections, said vault comprising:

a body having a peripheral wall with an upper end and a lower end, an upturned skirt around the lower end extending peripherally around the body; a plurality of buttresses interconnecting the peripheral wall to the skirt; an upwardly-facing rim extending around the upper end; a seat in said region depending from said rim, said seat comprising a re-entrant wall from said rim and an inwardly-extending flange, and a plurality of buttresses interconnecting said re-entrant wall and the inside of said peripheral wall; and a lid for closing said upper end, said lid comprising a top plate with an upper surface, and a plug depending from the lower surface of said top plate whereby to form an overhanging shoulder;

said lid and body being formed of a moldable organic plastic material, said lid fitting in said seat with its shoulder bearing on the rim;

locking means for releasably holding said lid to said body, said locking means comprising a lip on said flange, a fastener with a head, a shank and a thread on said shank, said shank being passed through an opening in said lid with its head against the lid;

a U shaped clip with two arms pressed onto said lip with the said arms on opposite sides of it, aligned with said fastener, said clip being made of metal and forming a thread adapted to engage the thread on the fastener, thereby to hold the lid to the body.

2. A subgrade vault according to claim 1 in which said vault and said lid are each so proportioned and arranged as to be moldable in a single molding operation.

3. A subgrade vault according to claim 2 in which the molding operation is injection molding or rotational molding.

4. A subgrade vault according to claim 1 in which detent means is provided on said body, releasably to retain said lid while it is in said seat.

5. A subgrade vault according to claim 4 in which said detent means is a local rise on the re-entrant wall so proportioned and arranged as to resist removal of the lid from the body.

6. A subgrade vault according to claim 1 in which said clip includes on one of its arms an extruded tubular neck which internally bears the respective thread on the clip.

7. A subgrade vault according to claim 6 in which the other of said arms includes a retainer partially punched from its respective arm, with a hole therethrough aligned with the tubular neck, said retainer being angularly deflected into the spacing between the arms so as to press against the lip to retain said clip to the lip, said fastener passing through said retainer in order to engage the thread in the neck.

8. A subgrade vault according to claim 7 in which catches are formed in the surface of one of said arms, rising into the region between said arms further to hold the clip to the lip.

9. A subgrade vault according to claim 1 in which said head of said fastener includes a non-symmetrical array of driving surfaces, whereby to form an array not adapted to be engaged by a conventional driver, whereby to frustrate unauthorized removal.

* * * * *